US005625163A

United States Patent [19]

Thiesen et al.

[11] Patent Number: 5,625,163

[45] Date of Patent: Apr. 29, 1997

[54] CARTRIDGE AMMUNITION HAVING ACCIDENTAL IGNITION PREVENTING MEANS

[75] Inventors: Stefan Thiesen, Willich; Thomas Heitmann, Unterlüss; Holger Brase, Bergen; Reiner Bukowski; Ulrich Schulte, both of Hermannsburg, all of Germany

[73] Assignee: Rheinmetall Industrie GmbH, Ratingen, Germany

[21] Appl. No.: 587,941

[22] Filed: Jan. 17, 1996

[30] Foreign Application Priority Data

Jan. 17, 1995 [DE] Germany ..... 195 01 122.8

[51] Int. Cl.[6] ..... F42B 5/02; F42B 12/38

[52] U.S. Cl. ..... 102/439; 102/470; 102/513

[58] Field of Search ..... 102/430, 439, 102/464, 469, 470, 513

[56] References Cited

U.S. PATENT DOCUMENTS

| | | | |
|---|---|---|---|
| 1,011,863 | 12/1911 | Semple | 102/513 |
| 2,592,623 | 4/1952 | Turnbull | 102/430 |
| 4,142,466 | 3/1979 | Ballreich et al. | 102/513 |
| 4,763,577 | 8/1988 | Romer et al. | 102/430 |
| 5,050,502 | 9/1991 | Hellman et al. | 102/430 |
| 5,265,540 | 11/1993 | Ducros et al. | 102/469 |
| 5,465,665 | 11/1995 | Diehl | 102/470 |

FOREIGN PATENT DOCUMENTS

| | | |
|---|---|---|
| 0237711 | 9/1987 | European Pat. Off. . |
| 3435417 | 4/1986 | Germany . |
| 2289749 | 11/1995 | United Kingdom . |

*Primary Examiner*—Harold J. Tudor
*Attorney, Agent, or Firm*—Spencer & Frank

[57] ABSTRACT

A cartridge includes a case defining an inner space and having a case bottom; a propellant powder accommodated in the inner space; a propellant igniter centrally arranged on the case bottom and having a closure remote from the case bottom; a projectile held by the case and having a rear portion extending into the inner space; a tracer assembly held in the rear portion and being spaced from the closure; and an arrangement for preventing the propellant igniter from pressing propellant powder into the tracer assembly.

13 Claims, 3 Drawing Sheets

CARTRIDGE AMMUNITION HAVING ACCIDENTAL IGNITION PREVENTING MEANS

BACKGROUND OF THE INVENTION

This invention relates to a cartridge ammunition having a cartridge case and a projectile. The projectile has a rear part which extends into the casing and in which a tracer assembly is arranged. The case contains propellant powder and further has, at the case bottom, a centrally arranged propellant igniter provided with a closure which is generally axially aligned with and spaced from the tracer assembly.

If a cartridge of the above-outlined type is, for example, accidentally dropped, an unintentional combustion thereof may occur if the propellant igniter, caused by forces derived from the shock, presses propellant granules into the tracer assembly, causing ignition of the latter.

SUMMARY OF THE INVENTION

It is an object of the invention to provide an improved cartridge of the above-outlined type which prevents an unintentional combustion of the cartridge in case it is accidentally dropped.

This object and others to become apparent as the specification progresses, are accomplished by the invention, according to which, briefly stated, the cartridge includes a case defining an inner space and having a case bottom; a propellant powder accommodated in the inner space; a propellant igniter centrally arranged on the case bottom and having a closure remote from the case bottom; a projectile held by the case and having a rear portion extending into the inner space; a tracer assembly held in the rear portion and being spaced from the closure; and an arrangement for preventing the propellant igniter from pressing propellant powder into the tracer assembly.

Thus, it is the essence of the invention to prevent, in case the cartridge is dropped, the propellant igniter from pushing propellant granules or parts of the propellant into the tracer assembly.

According to a preferred embodiment of the invention, between the closure of the propellant igniter and the tracer assembly a filler of inert material is positioned. The filler fills the space between the tracer assembly and the closure of the propellant igniter so that between the tracer assembly and the closure no propellant granules may be present.

According to another preferred embodiment of the invention, the igniter closure is configured such that its diameter is greater than the diameter of the inner space of the projectile guide assembly and the distance between the closure and the guide assembly is so small that propellant powder situated between the closure and the tracer assembly is not able to ignite the tracer due to the small axial mobility of the closure.

DESCRIPTION OF THE PREFERRED EMBODIMENTS

Figure 1:
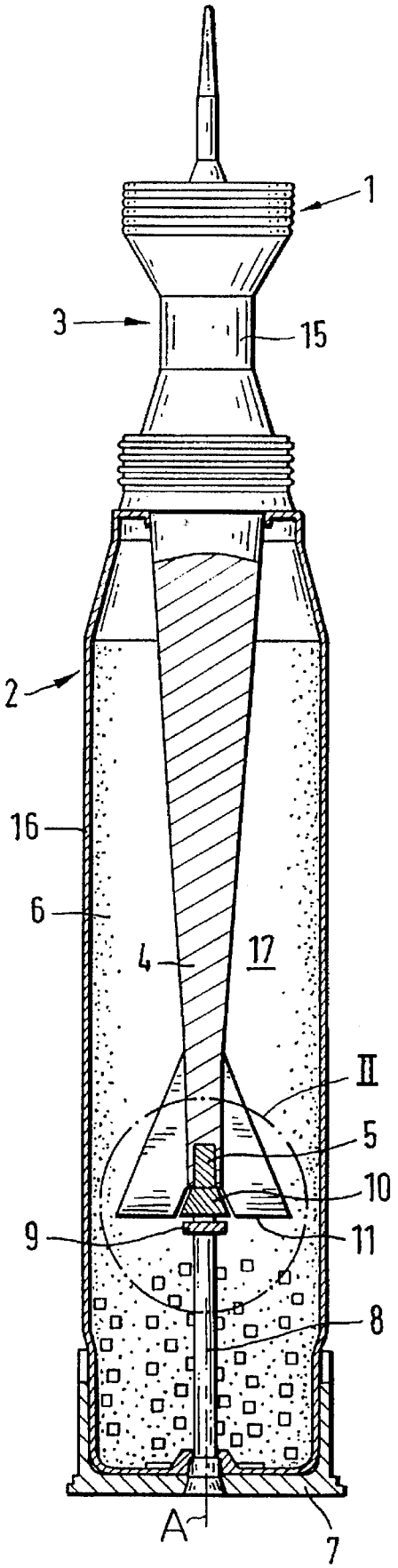
FIG. 1 is an axial sectional view of a cartridge ammunition having a fin-stabilized arrow projectile incorporating a preferred embodiment of the invention.

Turning to FIG. 1, there is illustrated therein a cartridge ammunition generally designated at 1 which essentially includes a case 2 and a subcaliber arrow projectile 3 having a sabot 15. The case 2, which has a longitudinal axis H, is formed of a combustible case jacket 16, defining an inner space 17, and a metal case bottom 7 secured to a rear terminal portion of the case jacket 16. A propellant igniter 8, filled with an igniting substance, is screwed into the center of the case bottom 7. The propellant igniter 8 extends axially into the inner case space 17 filled with propellant powder 6. The propellant igniter 8 is a tubular member sealed at its terminus by a closure 9 remote from the bottom 7. The closure 9 is preferably threadedly connected with the propellant igniter 8.

Figure 2:
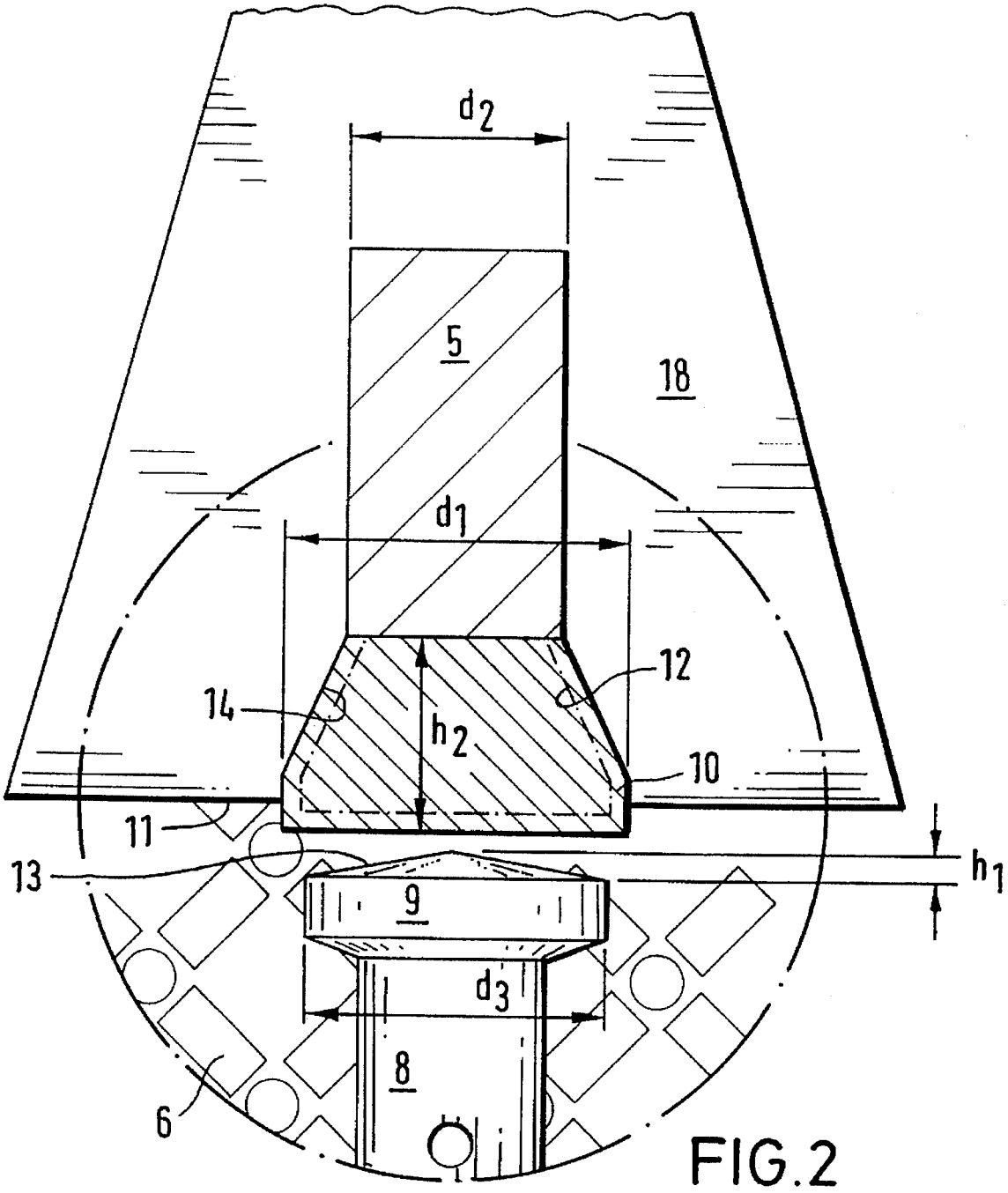
FIG. 2 is an enlarged view of inset II of FIG. 1.

Also referring to FIG. 2, between the closure 9 of the propellant igniter 8 and a tracer assembly 5 a filler member 10 of inert material is disposed. The material may be a synthetic substance, for example, hard foam or Styropor (polystyrene foam) or a material including kraft pulp in a proportion of at least 60%. The inert material makes a self-ignition of the filler member 10 impossible.

As a variant, the filler member is a weight-saving hollow body which, during the firing process, is destroyed at an early stage by the pressure, thus freeing the path for igniting the tracer assembly.

The filler member 10 arranged at the rear terminus 11 of the rear portion 4 of the projectile is dimensioned such that its maximum rearward diameter $d_1$ measured perpendicularly to the axis A is greater than the diameter $d_2$ of the tracer assembly 5, measured parallel to the diameter $d_1$. The filler member 10 may be easily installed and fixedly positioned in the inner space 14 of the guide assembly 18. The filler member 10 fully occupies the inner space 14. Further, the diameter $d_3$ of the closure 9, measured perpendicularly to the axis A is greater than the diameter $d_2$ of the tracer assembly 5 and smaller than the diameter $d_1$ of the filler member 10, so that the propellant igniter 8 is stopped by the closure 9 before reaching the tracer assembly 5. For this purpose, the tip portion 13 of the closure 9, extending axially away from the case bottom 7 expediently has an axially measured height $h_1$ which is less than the axially measured height $h_2$ of the filler member 10.

Figure 3:
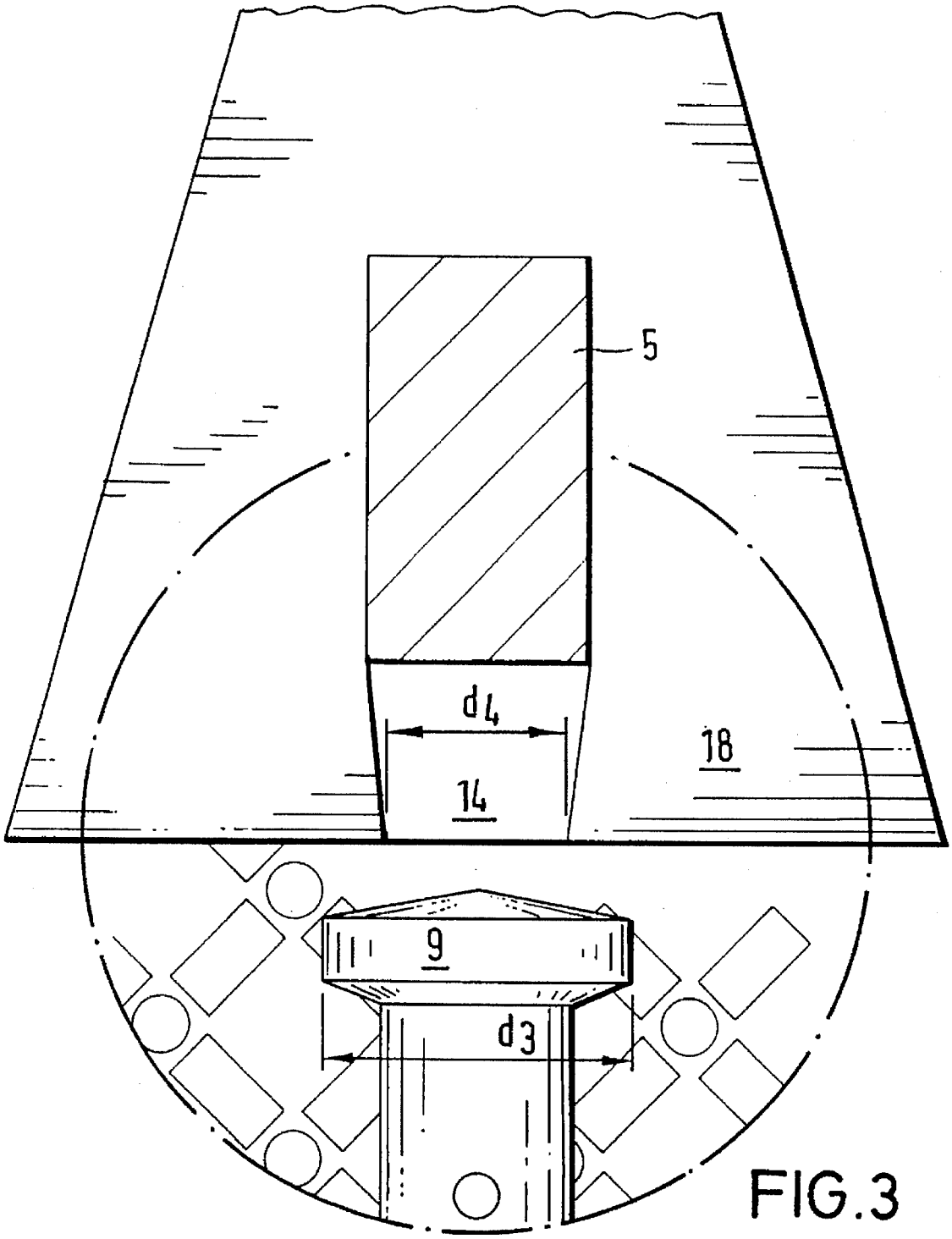
FIG. 3 is a view similar to FIG. 2, showing another preferred embodiment of the invention.

In the embodiment illustrated in FIG. 3, the diameter $d_3$ of the closure 9 of the propellant igniter 8 is greater than the diameter $d_4$ of the inner chamber 14 of the guide assembly 18. The inner chamber or rearward inner space 14 is situated axially between the tracer assembly 5 and the closure 9. The diameter $d_4$ is measured axially parallel to the diameter $d_3$. By virtue of this arrangement the axial mobility of the propellant igniter 8 is minimized by the cooperation of the closure 9 and the guide assembly 18, so that the buffer effect of the propellant granules suffices to prevent them from being pushed into the tracer assembly 5.

The closure 9 of the propellant igniter 8 is of a material which ensures that no sparks are generated upon contact with the guide assembly 18. The use of brass for the closure 9 has been proven to be particularly advantageous in case the guide assembly 18 is made of steel.

It will be understood that the above description of the present invention is susceptible to various modifications, changes and adaptations, and the same are intended to be comprehended within the meaning and range of equivalents of the appended claims.

What is claimed is:

1. A cartridge comprising (a) a case having a longitudinal axis and a case bottom; said case defining an inner space;

(b) a propellant powder accommodated in said inner space;

(c) a propellant igniter centrally arranged on said bottom and having a closure remote from said bottom;

(d) a projectile held by said case and having a rear portion extending into said inner space;

(e) a tracer assembly held in said rear portion; said tracer assembly being spaced from said closure; and (f) filler means for preventing said propellant igniter from pressing propellant powder into said tracer assembly; said filler means comprising a filler member of inert material positioned within the rear portion of the projectile between said closure and said tracer assembly; said filler member having a diameter $d_1$ measured generally perpendicularly to said longitudinal axis and said tracer assembly having a diameter $d_2$ measured parallel to the diameter $d_1$; the diameter $d_1$ being greater than the diameter $d_2$.

2. The cartridge as defined in claim 1, wherein said filler member is of a synthetic material.

3. The cartridge as defined in claim 1, wherein said filler member is of a hard foam material.

4. The cartridge as defined in claim 1, wherein said filler member is of polystyrene foam.

5. The cartridge as defined in claim 1, wherein said filler member includes kraft pulp in a preponderant proportion.

6. The cartridge as defined in claim 1, wherein said filler member is hollow.

7. The cartridge as defined in claim 1, wherein said closure has a diameter $d_3$ measured parallel to and being greater than the diameter $d_2$.

8. The cartridge as defined in claim 11, wherein said projectile includes a guide assembly and further wherein said closure is of a material which excludes spark generation upon contact between said closure and said guide assembly.

9. The cartridge as defined in claim 1, wherein said rear portion comprises a guide assembly; said filler member being positioned in a rearward inner space defined by said guide assembly.

10. A cartridge comprising (a) a case having a longitudinal axis and a case bottom; said case defining an inner space;

(b) a propellant powder accommodated in said inner space;

(c) a propellant igniter centrally arranged on said bottom and having a closure remote from said bottom; said closure having a diameter $d_3$ measured generally perpendicularly to said longitudinal axis;

(d) a projectile held by said case and having a rear portion extending into said inner space; said projectile including a guide assembly having a rearward inner space; said rearward inner space having a diameter $d_4$ measured parallel to the diameter $d_3$;

(e) a tracer assembly held in said rear portion; said tracer assembly being spaced from said closure; said rearward inner space being situated axially between said closure and said tracer assembly; the diameter $d_3$ being greater than the diameter $d_4$, whereby said propellant igniter is prevented from pressing propellant powder into said tracer assembly.

11. The cartridge as defined in claim 10, wherein said closure is of a material which excludes spark generation upon contact between said closure and said guide assembly.

12. A cartridge comprising (a) a case having a case bottom; said case defining an inner space;

(b) a propellant powder accommodated in said inner space;

(c) a propellant igniter centrally arranged on said bottom and having an end remote from said bottom;;

(d) a closure sealingly obturating said propellant igniter at said end thereof; said closure having a diameter $d_3$ measured generally perpendicularly to said longitudinal axis; said closure including a tip portion oriented axially away from said bottom; said tip portion having an axially measured height $h_1$;

(e) a projectile held by said case and having a rear portion extending into said inner space;

(f) a tracer assembly held in said rear portion; said tracer assembly being spaced from said closure; and (g) filler means for preventing said propellant igniter from pressing propellant powder into said tracer assembly; said filler means comprising a filler member of inert material positioned within the rear portion of the projectile between said closure and said tracer assembly; said filler member having an axially measured height $h_2$ being greater than said height $h_1$; said filler member having a diameter $d_1$ measured generally perpendicularly to said longitudinal axis and said tracer assembly having a diameter $d_2$ measured parallel to the diameter $d_1$; the diameter $d_1$ being greater than the diameter $d_2$ and the diameter $d_3$.

13. The cartridge as defined in claim 12 wherein said rear portion comprises a guide assembly; said filler member being positioned in a rearward inner space defined by said guide assembly.

* * * * *